US005152402A

United States Patent [19]

Matula

[11] Patent Number: 5,152,402

[45] Date of Patent: Oct. 6, 1992

[54] FLEXIBLY EMBEDDED DISC SCREEN

[75] Inventor: Conrad Matula, Memphis, Tenn.

[73] Assignee: Beloit Corporation, Beloit, Wis.

[21] Appl. No.: 681,823

[22] Filed: Apr. 8, 1991

[51] Int. Cl.[5] ..... B07B 1/16

[52] U.S. Cl. ..... 209/672; 209/667

[58] Field of Search ..... 209/667, 668, 672, 671

[56] References Cited

U.S. PATENT DOCUMENTS 1,641,777 9/1927 Newhouse ..... 209/672
2,618,385 11/1952 Silver et al. ..... 209/671 X
3,010,522 11/1961 Oppel ..... 209/671 X
3,771,651 11/1973 Hook ..... 209/672
4,653,648 3/1987 Bielagus ..... 209/672
4,972,959 11/1990 Bielagus ..... 209/672

*Primary Examiner*—Donald T. Hajec
*Attorney, Agent, or Firm*—Dirk J. Veneman; Raymond W. Campbell

[57] ABSTRACT

A disc screen or like rotatable shaft assembly is disclosed having a non-metallic, substantially-cylindrical resilient spacer. The spacer has a non-circular shaft receiving opening. A plurality of screen discs are embedded in the spacer to accommodate limited tilting of the discs. Annular metallic surrounds may be provided to cover exposed non-metallic surfaces of the spacer.

5 Claims, 3 Drawing Sheets

FLEXIBLY EMBEDDED DISC SCREEN

FIELD OF THE INVENTION

The present invention relates to disc screens in general and to disc screens with resilient spacers in particular.

BACKGROUND OF THE INVENTION

Disc screens are used for screening or classifying discrete materials such as wood chips, municipal wastes, and the like. Disc screens are made up of a screening bed with a series of co-rotating, spaced, parallel shafts, each of which has a longitudinal series of concentric screen discs which interdigitate with the screen discs of the adjacent shafts. Spaces between the discs (Interdisc facial opening, "I.F.O.") permit only material of specified size or smaller to pass downwardly through the bed of rotating discs. Since the discs are all driven to rotate in a common direction from the infeed end of the screen bed to the outfeed or discharge end of the bed, the particles of material which are larger than the specified size of material will be advanced on the bed to the outfeed end of the bed. Disc screens may be used for removing either oversize or undersize material, so that either flow may be accepts or rejects, depending on screen usage.

Prior disc screens employing screen discs rigidly attached to the co-rotating shafts were susceptible to damage from unwanted inclusions in the material to be screened such as large chips, rocks, or other foreign matter. These foreign objects tend to enter the screen and lodge between the discs, becoming trapped. With the discs being held rigid, the result may be the breakage of the discs or the destruction of the proper screening function.

The disc screen of U.S. Pat. No. 4,653,648 utilizes resilient plastic ring-shaped spacers inserted between the screen discs and placed under compression. Disc screens with flexible spacers permit the discs to flex so that minimally oversized chips and other objects which otherwise would wedge between discs will be allowed to pass through the screen. U.S. Pat. No. 4,741,444 discloses a disc screen with resilient plastic spacers and metallic surrounds substantially covering the outside surfaces of the spacers to protect the less-durable plastic from gouging and wear. Additional teachings of resilient spacers can be found in U.S. Pat. Nos. 4,972,959 and 4,972,960 and my co-pending U.S. application entitled "Disc Screen With Controlled Interfacial Openings" filed Mar. 18, 1991.

It would be desirable to fabricate a disc screen with resilient plastic spacers that required fewer parts and that would grip the screen discs on three faces, providing an advantageous snug fit while at the same time ensuring added flexibility and resilience for effectively handling large foreign objects.

SUMMARY OF THE INVENTION

The disc screen of this invention has an elongate, metallic shaft member and a plurality of screen discs. A non-metallic spacer media is cast around and between the inner circumference of the discs and defines an opening for receiving the metallic shaft member. The screen discs are disposed in the spacer media so as to accommodate limited tilting of the discs relative to the axis of the shaft with deflection of the spacer media. Optionally, metallic surrounds are located between the screen discs, encircling the spacer, and have an axial dimension of slightly less than the axial distance between the discs so that the spacer accommodates tilting of the discs without constraint from the surrounds.

It is an object of the present invention to provide a disc screen module with a single resilient plastic spacer.

It is a further object of this invention to provide a disc screen wherein the discs are elastically supported so as to be able to deflect out of their radial plane on a temporary basis to accommodate lumpy foreign elements and automatically return to their radial planes after the foreign elements have been discharged.

Another object of the present invention is to provide resiliently mounted disc assemblies which eliminate the need for complex apparatus to compressively connect the discs together.

Further objects, features, and advantages will be apparent from the accompanying detailed description of the preferred embodiment taken in conjunction with the accompanying drawings.

DESCRIPTION OF THE INVENTION

Figure 1:
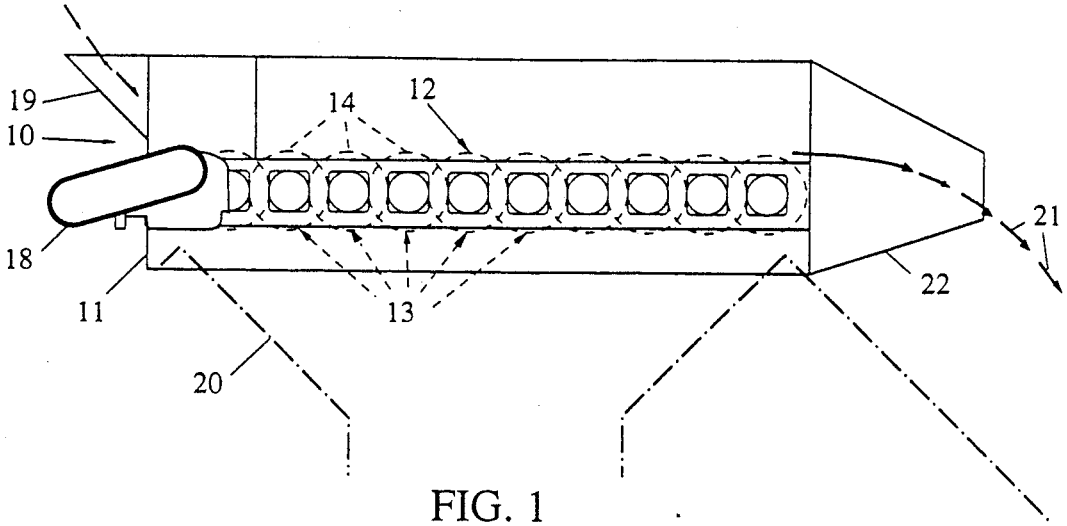
FIG. 1 is a schematic side-elevational view of a disc screen apparatus embodying the features of the invention.

Referring now to the FIGS. 1-5 wherein like numbers refer to like parts, FIG. 1 shows a disc screen apparatus 10 having a frame 11 supporting a screening bed 12 which has a series of co-rotating spaced parallel shaft assemblies 13 of cylindrical perimeter and similar length, and each of which has a longitudinal series of concentric metal screen discs 14. The discs 14 of each of the shaft assemblies 13 interdigitate with the discs of the adjacent shaft assemblies. Each rotary shaft 37 of each shaft assembly 13 is preferably hollow, and rotatably mounted on the frame 11. Unison driving of the shaft assemblies 13 in the same direction, clockwise as seen in FIG. 1, is adapted to be effected by suitable drive means 18.

While the present invention will be shown and described herein on what is commonly known as a flat screen, those skilled in the art will readily recognize that it can be used on other types of disc screens as well, such as those known as V-screens or split flow screens, wherein screening beds are disposed at angles upward from the horizontal, and in which chip flows are directed other than as described herein. Further, the invention may be used on disc screens which interdigitate as shown herein, and also those in which discs of adjacent shafts run in tip-to-tip relationship. The invention has application for all such disc screens where limited flexing of the discs is desirable, and should not be seen as limited to its use on a flat screen as shown.

Figure 3:
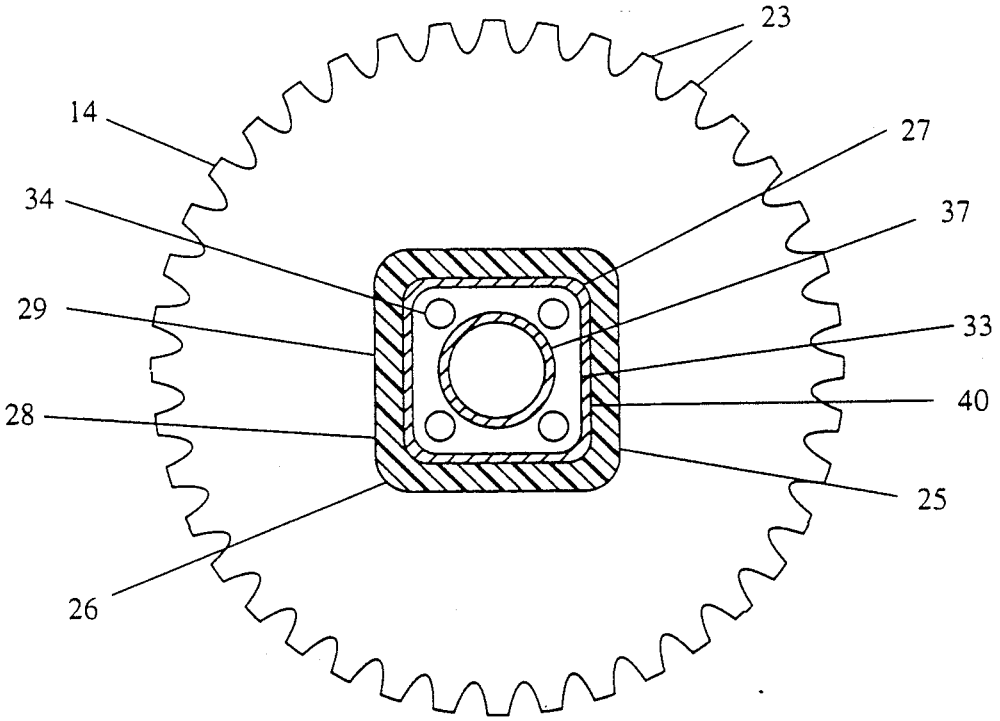
FIG. 3 is a cross-sectional view taken along section line 3—3 of FIG. 2.
Figure 4:
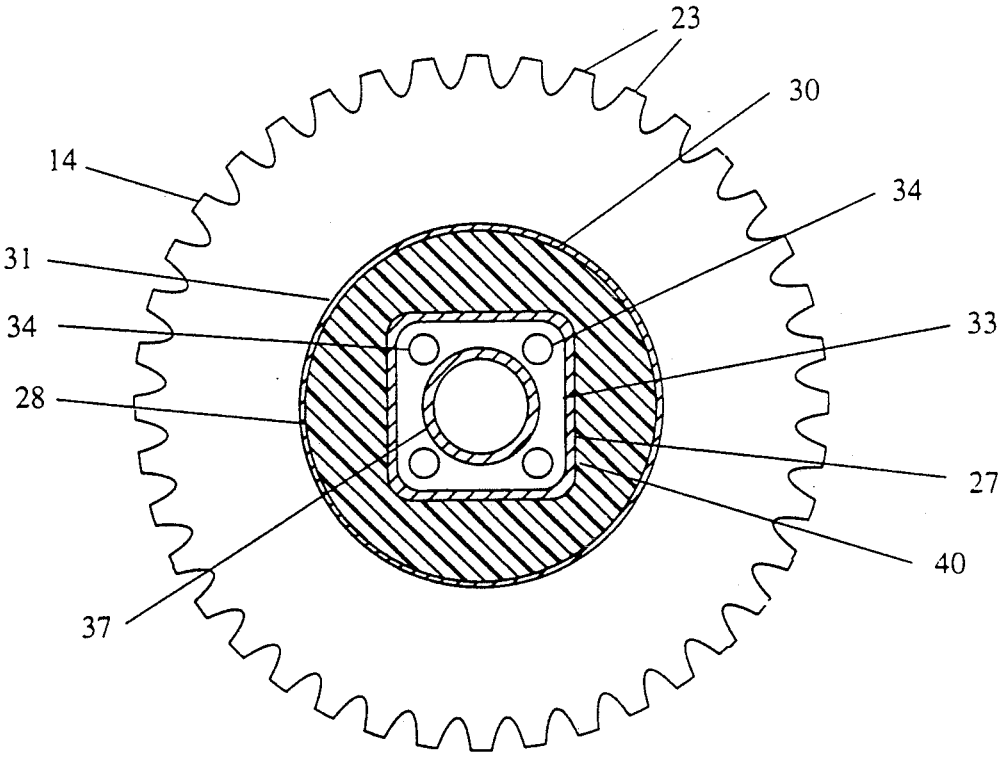
FIG. 4 is a cross-sectional view taken along section line 4—4 of FIG. 2.

Discrete material to be screened is delivered to the infeed end of the screening bed 12 by means of a chute 19. Material of the specified size or smaller drops through screening slots defined by and between the interdigitated portions of the discs 14, and is received in a hopper 20. Particles which are too large to pass through the screening slots are advanced along the bed and discharged, as indicated by directional arrows 21, from the discharge end of the screening bed, as by means of an outfeed chute 22. The screening function of the discs 14 may be enhanced by a uniform, generally sawtooth configuration of the outer perimeter of the screen discs 14 provided by teeth 23 as best seen in FIGS. 3 and 4. The number of such teeth and their size may be dictated by the particular material to be processed. Although shown as having a relatively sharp sawtooth shape, the teeth 23 may, depending upon use, be of different geometric forms, such as lobulate or the like.

Each of the discs 14 is spaced from each adjacent disc throughout the entire set of discs in each of the shaft assemblies 13, to provide the desired screening slot spaces between the annular interdigitated areas of the discs.

Figure 2:
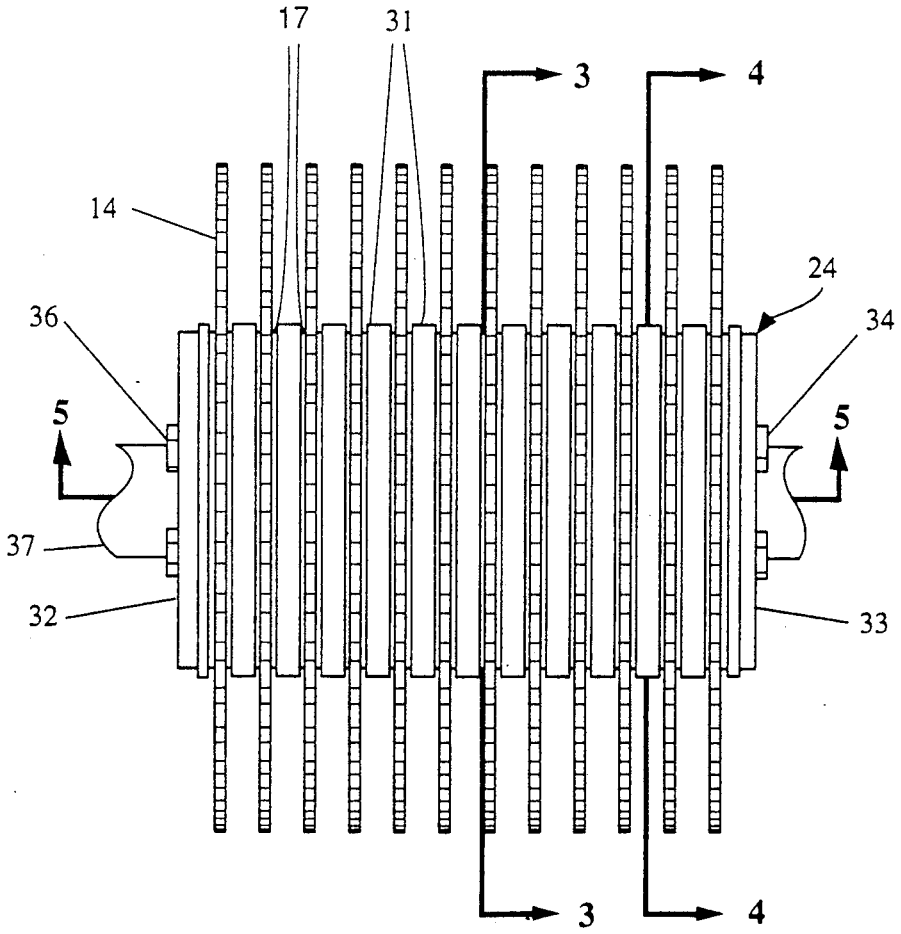
FIG. 2 is a side-elevational view of one of the disc screen modules of the apparatus of FIG. 1.

As shown in FIGS. 2–5, a plurality of screen discs 14 are provided which are mounted on a shaft 27 in axial spaced relation to provide spaces therebetween. The screen discs 14 are mounted in a non-metallic resilient spacer 28. The spacer has a basically cylindrical perimeter and a central non-circular shaft-receiving opening 40 to permit mounting of the spacer on a non-cylindrical hollow shaft 27. For convenience in assembling the discs 14 and spacer 28 on the rotary shaft 37, the discs and spacers are formed in convenient size modules 24 as shown in FIG. 2, such as 12 discs to each module.

In the spacer 28, the screen discs 14 each extend in a relatively true radial plane, being held in spaced relationship but permitted to tilt or cock slightly when an oversized foreign element is wedged between the discs.

The spacer is preferably of polyurethane material such as a polyurethane 90 A Durometer, but may be of any appropriate, hard, compressible plastic. Assembly of the discs is advantageously effectuated by casting the spacer as a liquid about the inner periphery of the annular screen discs, encapsulating the inner edges 26 of the discs. Many different casting techniques may be used, and holes provided in the discs to facilitate the flow of castable spacer material. Bonding agent may be applied to the disc surfaces to be covered during casting. A mold may be provided for holding the discs at the outer area of the discs. Spacers may be used to control spacing between discs.

The discs are firmly embedded in the spacer material, which is bonded thereto. The plastic, however, is sufficiently resilient when subjected to the forces caused by an oversized particle wedging between the screen discs that the screen discs deflect to allow the particle to be discharged. The discs then return to their original position, which is in an accurate radial plane. Since the spacer material is cast to completely fill the area between the discs, it is not necessary to use the compression apparatus previously used for assembling discs with separate discrete spacers.

In some situations, such as when the space between discs is particularly large, it may be desirable to utilize permanent spacers such as bushings or hubs on the discs to occupy some of the space between discs. In this manner, the volume of resilient spacer material is reduced, and the problems associated with shrinkage and set, as expressed in my aforementioned co-pending application, can be reduced.

In some applications, it is advantageous to avoid any exposed plastic surfaces on disc screens. This is the case in, for example, paper making operations which employ coaters. If it is desired to cover the exposed plastic surface of the spacer 28, annular rings or surrounds 31 may be provided around the outer circumferential surface portions 30 which extend between the discs. The surrounds may be split rings secured around the spacers after the cast material solidifies, or the surrounds may be rings placed between the discs before casting of the spacer material. The surrounds 31, shown in FIGS. 2, 4, and 5, essentially close or cover the space on the outer surface portions 30 of the plastic spacer, but in a preferred form, the axial dimension of the surrounds 31 is slightly less than the axial dimension of the circumferential surface portions 30, so that a slight space 17 may exist between the ends of each surround 31 and the surfaces of the adjoining screen discs 14. Thus, the surfaces 30 of the spacer 28 are fully protected from material between the discs so that abrasive materials, stones and other foreign objects do not chip or scratch the surface of the plastic spacer 28. Furthermore, there is no exposed plastic part which would be objectionable to paper manufacturers making coated papers.

Since the surrounds 31 are slightly shorter in axial length than the circumferential surfaces 30, the spacer still functions to permit deflection of the screen discs 14. The allowed flexing permits the discharge of chips, rocks, and other foreign objects, but limits the flexing so that the discs do not break due to interference with one another. In a preferred form, the surrounds 31 are sized so that there is clearance of approximately 0.381 mm between the ends of the surround 31 and the screen discs 14.

The spacer 28 is sized so that it can be slid over the shaft 27 which is of a non-circular cross section, conveniently generally square, and which may be of any desired length, but is commonly about ten feet long, to accommodate up to 144 screen discs 14. Shaft assemblies of this size are especially suitable for disc screens for screening wood chips as used in the paper making industry. The spacer 28 slides over the rectangular shaft 27, so that stable positioning of the parts occurs during rotation, and vibration or oscillation is prevented.

Figure 5:
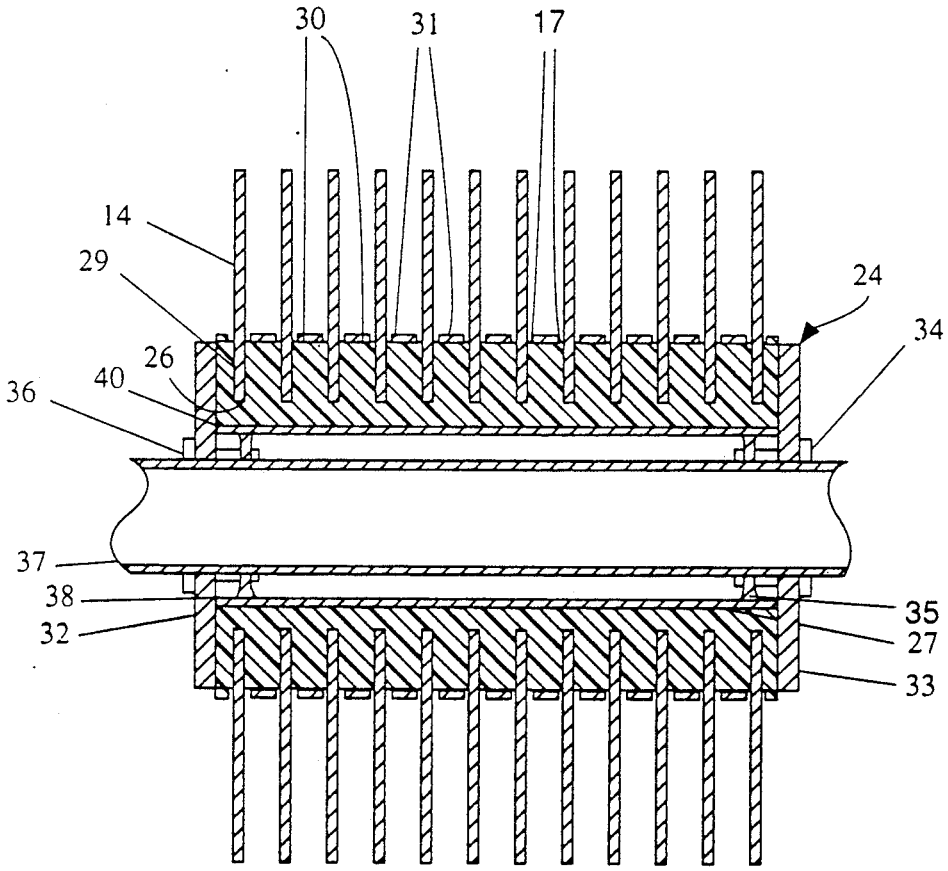
FIG. 5 is a cross-sectional view taken along section line 5—5 of FIG. 2.

As best shown in FIG. 5, the rectangular shaft 27 has internal plates 35 welded therein spaced inwardly from the ends 38 of the shaft 27. An end plate 32 is clamped to an internal plate 35 on one end, and an end plate 33 is clamped to an internal plate 35 on the other end, with the end plates applying a compressive force to the module. Cap screws 34 and 36 are inserted through the end plates 32 and 33 respectively, and threaded in the plates 35. When the screws are tightened, the plates 32, 33 are drawn up tight against the ends 38 of the shafts 27, thereby securing the module or modules on the shaft 27. A center rotary shaft 37 extends through the plates 32, 33 and 35 for purposes of mounting the modular assembly for rotation. By choosing the length of the shaft 27 to be critical, the end plates 32 and 33 can be drawn down tightly against the ends of the shaft 27 by the bolts 34 and 36, so that the desired compression is applied to the module. As discussed above, the surrounds 31 are of a length so that a small space 17 will remain between the surrounds 31 and the screen discs 14, to permit but to limit tilting movement or deflection of the screen discs 14.

It should be noted that screen disc modules may be constructed of any desired length, and that the screen discs and surround discs may be of any desired diameters to appropriately screen out material of a determined size. Shaft assemblies 13 and disc screen apparatuses 10 can thus be constructed of any desired length by putting together the desired number of modules on a common rotary shaft 37.

It is to be understood that the invention is not confined to the particular construction and arrangements of parts herein illustrated and described, but embraces such modified forms thereof as come within the scope of the following claims.

I claim:

1. A disc screen shaft assembly comprising:

an elongate metallic shaft member;

a non-metallic elongate cylindrical spacer having a shaft receiving opening therein and supported on the shaft member; and a plurality of screen discs embedded in and bonded to the spacer in spaced relation to each other, the spacer encapsulating the inner edges of the discs and accommodating limited tilting of the discs relative to the axis of the shaft with deflection of the spacer.

2. A disc screen rotatable shaft assembly comprising:

an elongate shaft member;

a compressible plastic elongate cylindrical spacer having a shaft receiving opening and supported on the shaft member and having circumferential surface portions;

a plurality of screen discs embedded in and bonded to the spacer with the spacer encapsulating the inner edges of the discs, each disc of said plurality of screen discs extending substantially radially from said spacer in parallel planes; and an annular metallic protective surround encircling the circumferential surface portions and providing a radially outwardly facing metallic protective surface to substantially cover each of the circumferential surface portions of the compressible spacer and to face material directed onto the screen between the discs.

3. A disc screen shaft assembly constructed in accordance with claim 2:

wherein the surrounds are of an axial length slightly less than the axial length of the circumferential surface portions of said spacer, so that deflection of the discs out of their radial planes will deform the spacer but not the surrounds.

4. A disc screen rotatable shaft assembly having a plurality of screen discs mounted co-rotatively on a non-cylindrical shaft member, wherein the improvement comprises:

an elongate unitary resilient plastic cylindrical spacer having a central axial shaft receiving opening and mounted on the shaft member and inner edges of said plurality of screen discs being embedded in and encapsulated by the spacer so that deflection of the discs will cause compression of the spacer to permit the discharge of foreign objects lodged between screen discs.

5. A module for disc screen rotatable shaft assemblies comprising:

a non-metallic elongate cylindrical spacer having a shaft receiving opening; and a plurality of screen discs embedded in the spacer, with inner edges of discs being encapsulated by the spacer so that the spacer accommodates limited tilting of the discs relative to the axis of the spacer with deflection of the spacer.

* * * * *